US012281887B2

(12) United States Patent
Miller, Jr. et al.

(10) Patent No.: US 12,281,887 B2
(45) Date of Patent: Apr. 22, 2025

(54) PORTED PRESS ADAPTER PRESS MANDREL SYSTEM AND METHOD OF USING SAME

(71) Applicant: K&M Shooting Products, LLC, Holland, MI (US)

(72) Inventors: Roger G. Miller, Jr., West Olive, MI (US); David A. Allen, Grandville, MI (US)

(73) Assignee: K&M Shooting Products, LLC, Holland, MI (US)

( * ) Notice: Subject to any disclaimer, the term of this patent is extended or adjusted under 35 U.S.C. 154(b) by 94 days.

(21) Appl. No.: 18/182,142

(22) Filed: Mar. 10, 2023

(65) Prior Publication Data

US 2024/0302147 A1 Sep. 12, 2024

(51) Int. Cl.

| | |
|---|---|
| ***F42B 33/10*** | (2006.01) |
| ***F42B 3/00*** | (2006.01) |
| ***F42B 35/02*** | (2006.01) |
| *F42B 33/00* | (2006.01) |

(52) U.S. Cl.

CPC ..... *F42B 33/10* (2013.01); *F42B 35/02* (2013.01); *F42B 33/001* (2013.01)

(58) Field of Classification Search

CPC ..... F42B 33/10; F42B 33/00; F42B 33/001; F42B 35/02; B21K 21/04

USPC ..... 86/24, 28, 33, 37, 40

See application file for complete search history.

(56) References Cited

U.S. PATENT DOCUMENTS

| | | | | |
|---|---|---|---|---|
| 4,133,249 | A | 1/1979 | Bachhuber et al. | |
| 4,723,472 | A | 2/1988 | Lee | |
| 5,635,661 | A * | 6/1997 | Tuftee | F42B 33/10 86/24 |
| 6,397,720 | B1 * | 6/2002 | Fox | F42B 33/10 86/24 |
| 7,681,481 | B1 * | 3/2010 | Buckley | F42B 33/005 86/26 |
| 8,408,112 | B2 | 4/2013 | Keska | |
| 8,827,607 | B1 * | 9/2014 | Goodman | B23B 5/168 408/202 |
| 9,146,087 | B2 * | 9/2015 | Cottrell | F42B 33/10 |
| 9,541,365 | B2 * | 1/2017 | Giraud | F42B 35/02 |
| 10,473,444 | B1 | 11/2019 | Gent | |

* cited by examiner

*Primary Examiner* — James S Bergin
(74) *Attorney, Agent, or Firm* — Frank M. Scutch, III

(57) ABSTRACT

A Ported Press Adapter Expand Mandrel System (PPAEMS) includes a Ported Press Adapter (PPA) as a significant advancement beyond the Expand Mandrel Window Riser (EMWR) by adding multiple radial holes to provide increased light intrusion, full 360° visibility, and balanced stress distribution with a pattern of port holes, slots, or other openings. Additional clarity is provided by an ancillary light source directed into the working area. Utilizing a small diameter Mandrel Holder (MH) allows for a wide range of mandrel diameters for installation in tight working areas (coax and progressive presses) and improves axially precision with a fine thread pitch.

18 Claims, 5 Drawing Sheets

PORTED PRESS ADAPTER PRESS MANDREL SYSTEM AND METHOD OF USING SAME

FIELD OF THE INVENTION

The present invention relates generally to reloading of firearm ammunition and more particularly to firearm ammunition reloading to precisely size the case neck of a spent casing for bullet seating, neck turning, and other related operations.

BACKGROUND

When reloading firearm ammunition, it is common to use a reloading press to prepare a shell casing to receive a new bullet. Precise neck sizing for bullet tension is a significant factor for long range shooting accuracy and precision. The state-of-the-art sizing methods are either done from the outside (e.g., full length die or neck bushing) or from the inside (e.g., expander ball or mandrel). One limitation of the inside expanding with mandrels, and full-length-dies, are that apparatus blocks the user from seeing where and how the cartridge interacts with an expand mandrel.

When reloading ammunition, the expand mandrel is used with the press to properly size the opening in the shell casing for the bullet. The expand mandrel is attached to the top of the reloading press, and the shell casing is loaded into the lower, moving portion. When the operator actuates the press handle, the shell casing is pressed over the expand mandrel. To prevent the opening in the shell casing from being enlarged too much or being damaged, it is important that the casing is not pressed too far onto the expand mandrel. However, because of how the expand mandrel is mounted in the press, the operator cannot see the shell casing during this important operation. Instead, the operator must rely on a mechanical stop at the end of the expand mandrel to prevent the shell casing from going too far.

Solutions to this issue have included the use of an Expand Mandrel Window Riser (EMWR). The EMWR has an opening in the side for the operator to view the shell casing as it is pressed onto the expand mandrel. The operator can adjust the expand mandrel position to match the stroke length of the reloading press and prevent damage to the shell casings from pressing too far onto the expand mandrel. This allows the operator to directly observe every shell casing during the expand mandrel sizing operation, the EMWR makes this important step in the process easier to monitor and control. However, limitations persist with limited range of travel and reloading press compatibility, limited light intrusion, rotational dependence on visibility, unbalanced stress distributions, and limited large diameter caliber body size, amongst other factors including manufacturability. Thus, new solutions are needed to enable a more reliable and consistent process when reloading ammunition.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION

Figure 1:
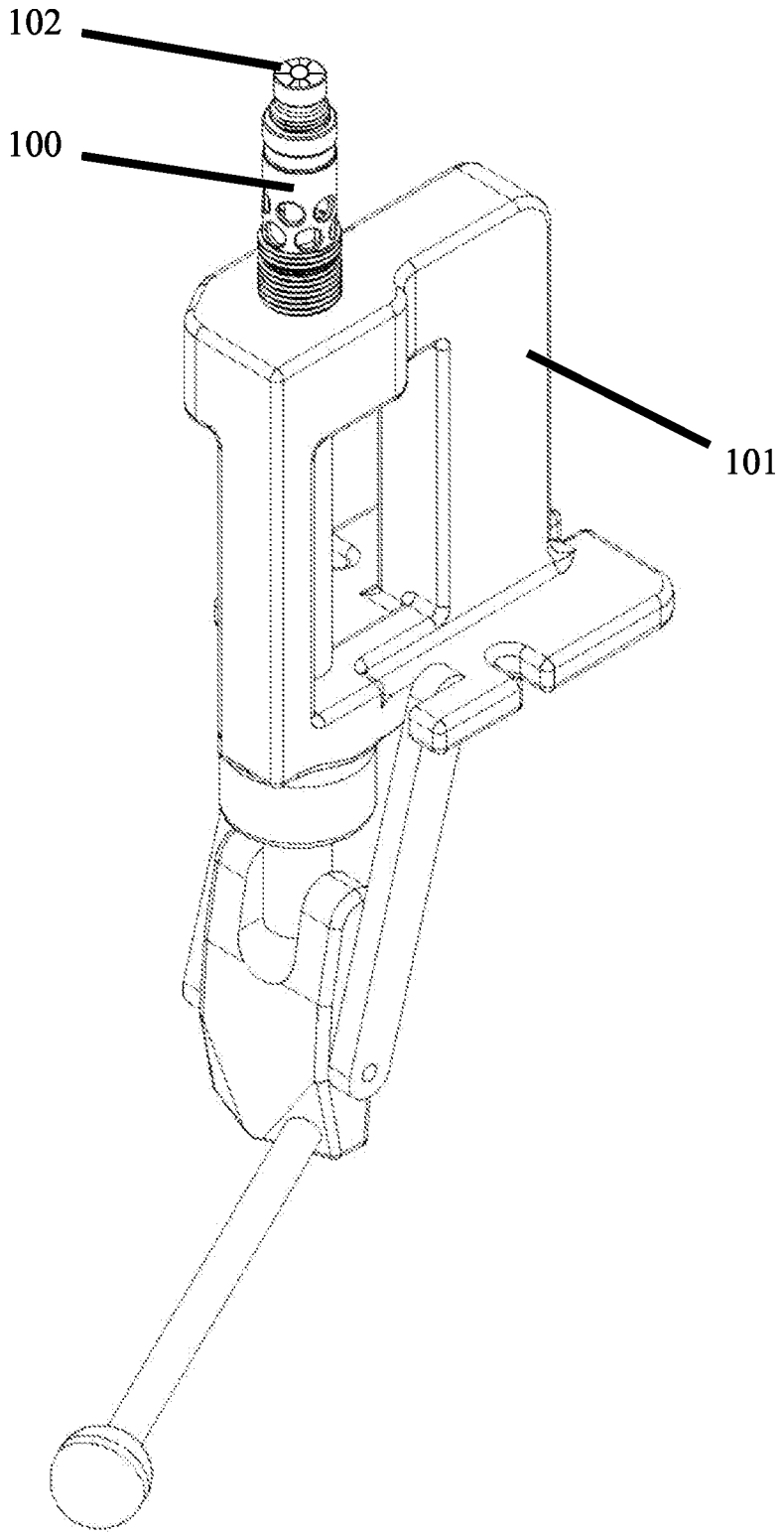
FIG. 1 an isometric view illustrating a ported press adapter expand mandrel system as used on a reloading press according to an embodiment of the invention.

Before describing in detail embodiments that are in accordance with the present invention, it should be observed that the embodiments reside primarily in combinations of method steps and apparatus components related to a ported press adapter expand mandrel system generally for reloading ammunition. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

Figure 2A:
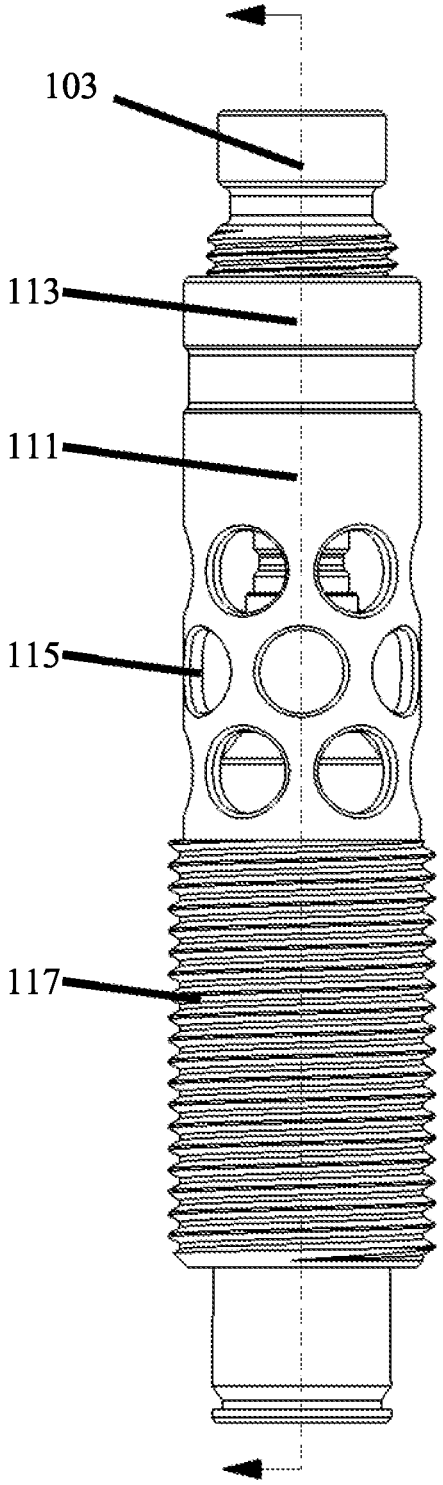
FIG. 2A is a side-view illustrating a ported press adapter expand mandrel system with three rows of radial port holes according to an embodiment of the invention.
Figure 2B:
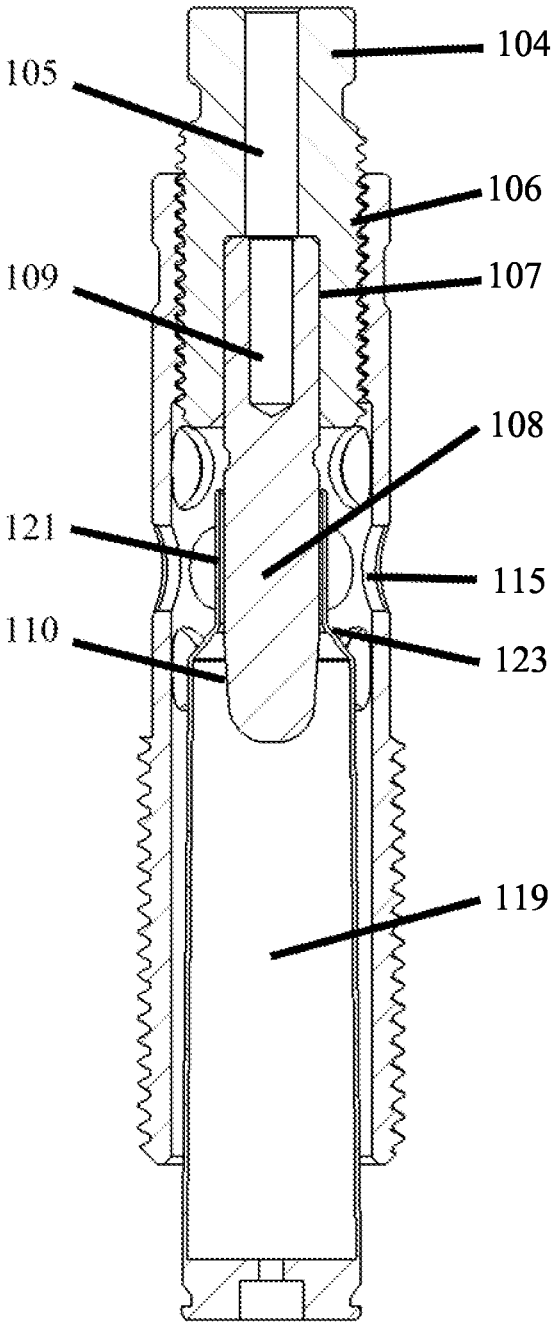
FIG. 2B is a cross-sectional view of FIG. 2A illustrating a ported press adapter, mandrel holder and an expand mandrel according to an embodiment of the invention.

FIG. 1 is an isometric view illustrating a Ported Press Adapter Expand Mandrel System (PPAEMS) 100 installed on a conventional, single-stage reloading press 101. As used herein, the terms "cartridge" or "shell casing" are used interchangeably and refer to an substantially cylindrical ammunition housing typically made of brass or a brass alloy. FIG. 2A is a closeup side-view illustrating a PPAEMS 101 with three rows of radial port holes 115. FIG. 2B is a cross-section of FIG. 2A. The PPAEMS consists of a ported press adapter (PPA) 111 with a body 113 having a diameter smaller than the minor diameter of the exterior threads 117 which is used for coarse vertical adjustment of the system. The body is ported with a plurality of openings 115 to observe through at least one opening the expand mandrel (EM) 108 engage with the cartridge 119 case neck 121.

To further enhance observation for the sizing operation, a plurality of openings 115 provide increased light intrusion, full 360° visibility, and balanced stress distribution with a pattern of port holes, slots, or other shaped openings. Those skilled in the art will recognize that various shape of holes maybe be used in various orientations around the body 113. The EM 108 and mandrel holder (MH) 103 are aligned by a shank and counterbore hole 107 in each component, respectively. The two components are bolted together utilizing a threaded hole 109 and through-hole 105. Fine vertical adjustment is accomplished by smaller, finer threads 106 than the PPA threads 117. Radial graduation markings 102 indicate vertical travel per angular adjustment of the MH 103. The MH body 104 has a smaller diameter than the minor diameter of the exterior threads 106 which allows for threading fully into the PPA in a forward or backward orientation as in FIG. 4C.

The EM leverages a tapered acute angle lead-in 110 for the cartridge 119 case neck 121 to reduce down-force for minimizing cartridge deformation at the neck-shoulder junction 123 which can form a bulge or "donut" for a non-uniform neck diameter. The EM 108, 303, 317 is sized larger than the neck size 121, 307 of a casing to accommodate spring-back of the material used to form the casing. Spring-back occurs due to the plastic-elastic characteristic of the casing material. Those skilled in the art will further recognize that it is typical that any deformation will have both elastic and plastic deformation. After the casing is removed from the EM, the elastic deformation will be released and only the plastic deformation will remain.

Figure 3A:
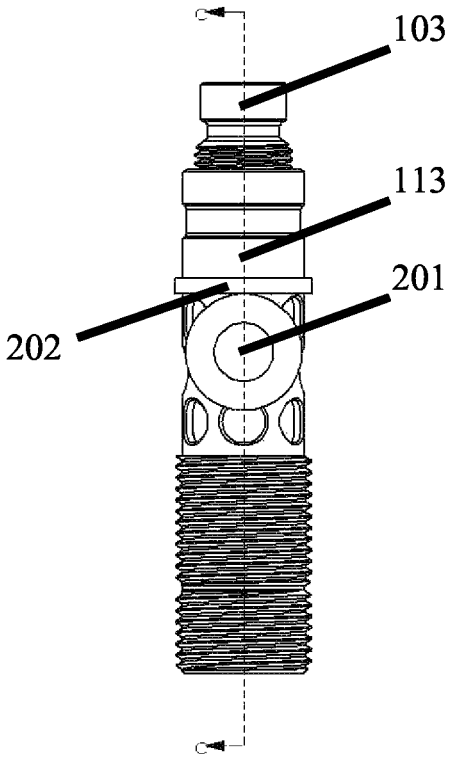
FIG. 3A is a side-view illustrating a ported press adapter expand mandrel system with ancillary light source according to an embodiment of the invention.
Figure 3B:
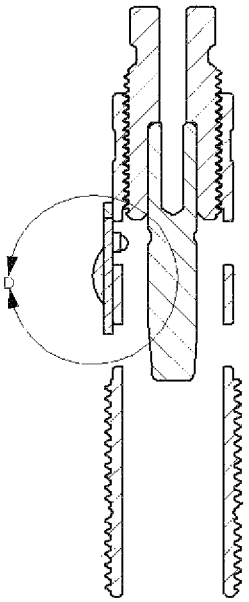
FIG. 3B is a cross-sectional view of the ported press adapter expand mandrel system FIG. 3A with detail circle of ancillary light source according to an embodiment of the invention.
Figure 3C:
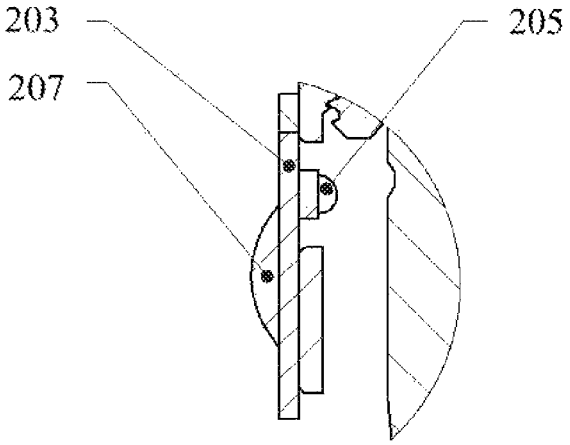
FIG. 3C is a detail view of detail circle from FIG. 3B of components of auxiliary light source according to an embodiment of the invention.

FIGS. 3A, 3B, and 3C illustrate additional clarity provided by an ancillary light source (ALS) 201 directed into the working area with a light 205. The ALS can be clipped 202 onto a PPA or integrated directly into a PPA 113 or MH 103. Using a printed circuit board (PCB) 203 and multi-function switch 207 to control light intensity 205, color wavelengths 205, and energy supply from a battery or external power source.

Figure 4A:
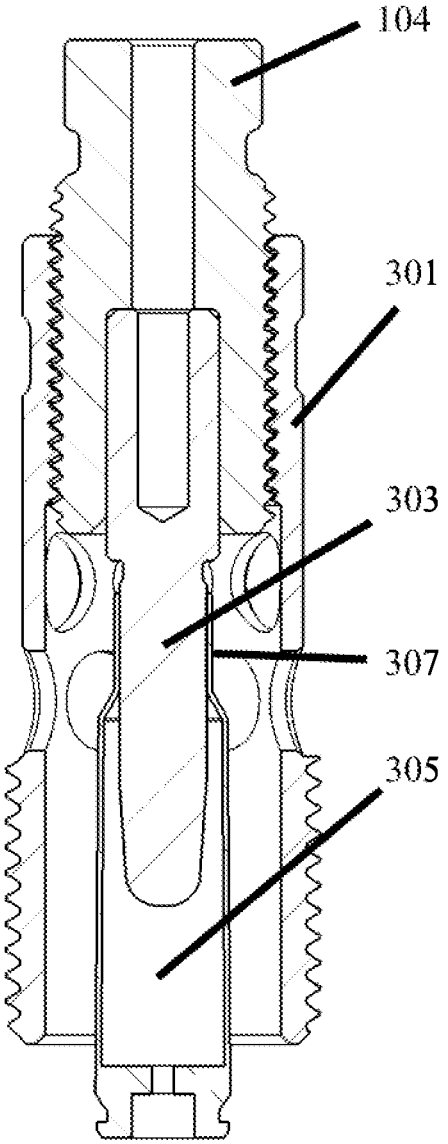
FIG. 4A is a cross-sectional view illustrating a shorter ported press adapter expand mandrel system with two rows of radial port holes according to an embodiment of the invention.

FIG. 4A illustrates a short PPA 301 with two rows of ports for medium length cartridges 305 which generally have smaller caliber cartridge case necks 307 and corresponding smaller EM's 303.

Figure 4B:
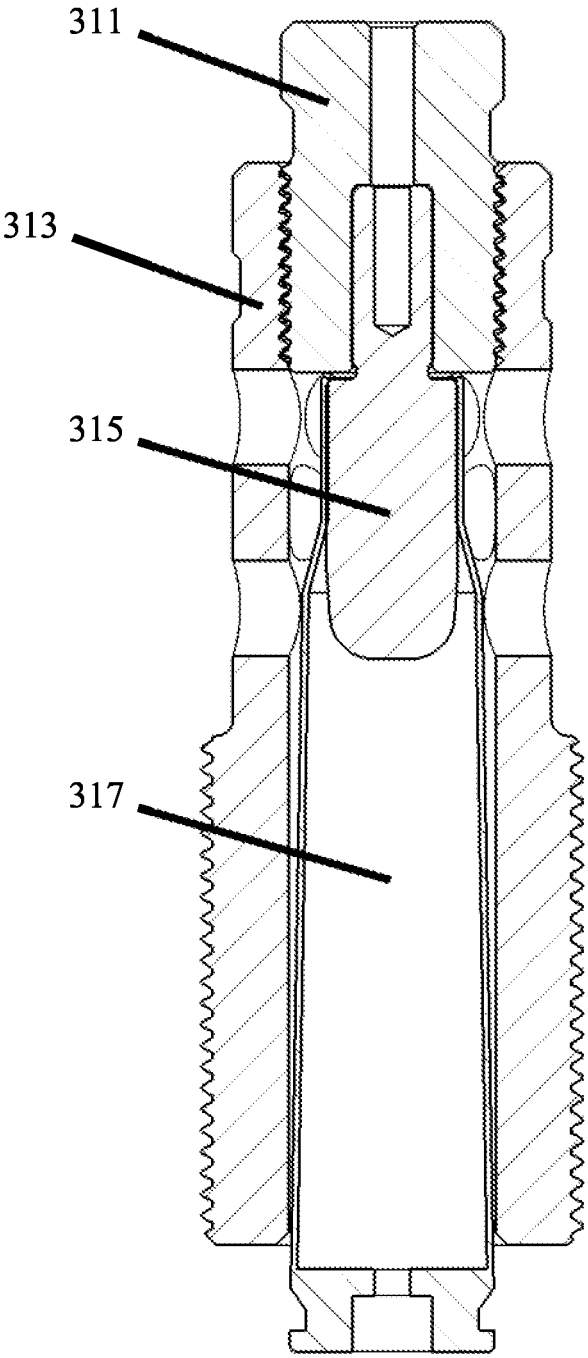
FIG. 4B is a cross-sectional view illustrating a longer and larger ported press adapter expand mandrel system with three rows of radial port holes for larger cartridges according to an embodiment of the invention.

FIG. 4B similarly illustrates a taller, larger diameter PPA 313 for larger and/or longer cartridges 317 and corresponding larger EM's 315 and MH's 311.

Figure 4C:
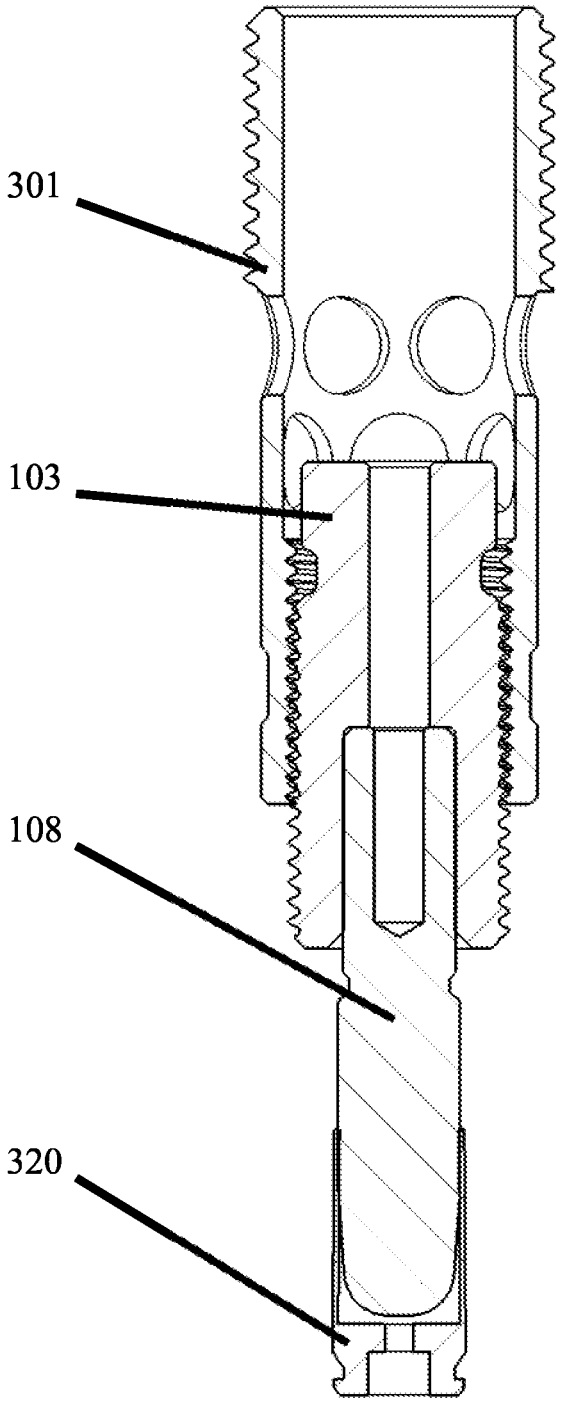
FIG. 4C is a cross-sectional view illustrating the shorter ported press adapter expand mandrel system shown in FIG. 4A mounted upside-down for very short cartridges according to an embodiment of the invention.

FIG. 4C illustrates very short cartridges 320, often for pistols, leveraging the smaller body diameters of both the PPA 301 and MH 103 to thread up and into the mating threaded holes in a backwards configuration. In this illustration the reloading press 101 threaded hole is not visible.

The method of using the PPAEMS as disclosed herein begins with selecting applicable PPA and MH for a specific press and cartridge size and length. An applicable EM is selected and sized for casing spring-back. A coarse vertical adjustment is accomplished with the threads on the PPA. A fine vertical adjustment is accomplished with threads on the MH. Radial markings on the top of MH allow for precise feedback on vertical adjustment. When using the ALS, the press is cycled while making coarse, then fine vertical adjustments to achieve a desired vertical position. Thereafter, applicable operations are performed to size case necks and the inside neck diameter is measured with gauging device, e.g., gage pin, camera, bore micrometer, etc. If case neck is not the appropriate size, a different EM size is selected and the method repeated. Those skilled in the art will recognize that the invention provides for very consistent case neck inside diameters allowing for more consistent ammunition reloading and higher firing accuracy.

Thus, embodiments of the present invention are directed to a ported press adapter expand mandrel system machined from a metal such as aluminum or steel. The ported press adapter threads into the reloading press where the expand mandrel is ordinarily installed. The expand mandrel is fastened to a mandrel holder with a screw, made of a similar material, and threaded into the ported press adapter. When used in reloading ammunition, the system providing for easier and more precise size the case neck for bullet seating, neck turning, and other related operations.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. A ported press adapter expand mandrel system (PPAEMS) for use in reloading of firearm ammunition comprising:

a ported press adapter having a threaded body;

a mandrel holder inserted within the ported press adapter;

an expand mandrel configured within the mandrel holder where the position of the expand mandrel is viewable though a plurality of port openings forming a circle in the ported press adapter such that the plurality of ports are configured directly adjacent to a plurality of external threads used for insertion into a reloading press;

wherein the expand mandrel is inserted within a spent casing to precisely size the case neck for ammunition reloading.

2. A PPAEMS as in claim 1, wherein a plurality of ports is a pattern of openings.

3. A PPAEMS as in claim 1, wherein the threaded body is configured to be installed either in a forward or backward direction into a reloading press.

4. A PPAEMS as in claim 1, wherein the mandrel holder is counter-bored for alignment with the expand mandrel.

5. A PPAEMS as in claim 1, wherein the mandrel holder includes a plurality of radial graduation markings for indicating an amount of vertical travel of the mandrel holder within the ported press adapter per angular rotation.

6. A PPAEMS as in claim 1, wherein the expand mandrel is sized larger than a target neck size of a casing to accommodate spring-back.

7. A PPAEMS as in claim 1, wherein the expand mandrel includes a tapered acute angle lead-in for the cartridge.

8. A PPAEMS as in claim 1, further comprising:

an ancillary light source for viewing inside the ported press adapter.

9. A PPAEMS as in claim 8, wherein the ancillary light source is integrated with the press adapter.

10. A PPAEMS as in claim 8, wherein the ancillary light source is variable in brightness and color selection.

11. A ported press adapter expand mandrel system (PPAEMS) for use in reloading of firearm ammunition comprising:

a ported press adapter having a threaded body and a plurality of port openings for viewing within its interior where the a plurality of port openings form a circle in the threaded body such that the plurality of ports are configured directly adjacent to a plurality of external threads used for insertion into a reloading press;

a mandrel holder having a threaded body attached to the port press adapter; and wherein an expand mandrel within the mandrel holder moves to size the case neck of a firearm cartridge such that a portion of the mandrel is viewable through at least one port opening.

12. A PPAEMS as in claim 11, wherein the threaded body is installed either in a forward or backward direction into a threaded hole.

13. A PPAEMS as in claim 11, wherein the mandrel holder is counter-bored for alignment with the expand mandrel.

14. A PPAEMS as in claim 11, wherein the mandrel holder includes a plurality of radial graduation markings for indicating an amount of vertical travel of the mandrel holder within the ported press adapter per angular rotation.

15. A PPAEMS as in claim 11, wherein the expand mandrel is sized larger than a target neck size of a casing to accommodate spring-back.

16. A PPAEMS as in claim 11, wherein the expand mandrel includes a tapered acute angle lead-in for the cartridge.

17. A PPAEMS as in claim 11, further comprising:

an ancillary light source configured with the press adapter for viewing inside the ported press adapter.

18. A PPAEMS as in claim 17, wherein the ancillary light source is variable in brightness and color selection.

* * * * *